US007180512B2

(12) United States Patent
Kumagai et al.

(10) Patent No.: US 7,180,512 B2
(45) Date of Patent: Feb. 20, 2007

(54) INTEGRATED CIRCUIT FREE FROM ACCUMULATION OF DUTY RATIO ERRORS

(75) Inventors: Masao Kumagai, Kawasaki (JP); Hideto Fukuda, Kawasaki (JP); Shinya Udo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 233 days.

(21) Appl. No.: 10/335,925

(22) Filed: Jan. 3, 2003

(65) Prior Publication Data

US 2003/0142053 A1 Jul. 31, 2003

(30) Foreign Application Priority Data

Jan. 29, 2002 (JP) ..... 2002-019518

(51) Int. Cl.

| | |
|---|---|
| ***G09G 5/00*** | (2006.01) |
| ***G09G 5/10*** | (2006.01) |
| ***G09G 3/34*** | (2006.01) |
| ***G09G 3/36*** | (2006.01) |

(52) U.S. Cl. ..... 345/204; 345/690; 345/98; 345/84

(58) Field of Classification Search ..... 345/204, 345/90, 690, 30, 48, 84, 98

See application file for complete search history.

(56) References Cited

U.S. PATENT DOCUMENTS

| | | | | |
|---|---|---|---|---|
| 5,712,652 | A * | 1/1998 | Sato et al. | 345/90 |
| 5,990,857 | A * | 11/1999 | Kubota et al. | 345/98 |
| 6,344,843 | B1 * | 2/2002 | Koyama et al. | 345/204 |
| 6,380,918 | B1 * | 4/2002 | Chiba et al. | 345/90 |
| 2002/0075248 | A1 * | 6/2002 | Morita et al. | 345/204 |

FOREIGN PATENT DOCUMENTS

| | | |
|---|---|---|
| CN | 1246698 A | 3/2000 |
| JP | 11-17544 | 1/1999 |
| JP | 11-194748 A | 7/1999 |
| JP | 2001-166750 | 6/2001 |
| JP | 2001-265288 A | 9/2001 |

* cited by examiner

*Primary Examiner*—Kee M. Tung
*Assistant Examiner*—Chante Harrison
(74) *Attorney, Agent, or Firm*—Arent Fox PLLC

(57) ABSTRACT

An integrated circuit includes a first signal-inversion switching circuit which receives a signal supplied from an exterior thereof as a first input signal, followed by outputting the first input signal after logic inversion thereof in response to a first state of a switching signal and outputting the first input signal without logic inversion in response to a second state of the switching signal, a signal processing circuit which performs signal processing based on the output of the first signal-inversion switching circuit, and a second signal-inversion switching circuit which receives the output of the first signal-inversion switching circuit passing through the signal processing circuit as a second input signal, followed by outputting the second input signal after logic inversion thereof in response to the second state of the switching signal and outputting the second input signal without logic inversion in response to the first state of the switching signal.

8 Claims, 6 Drawing Sheets

INTEGRATED CIRCUIT FREE FROM ACCUMULATION OF DUTY RATIO ERRORS

BACKGROUND OF THE INVENTION

1. Field of the Invention

The present invention generally relates to integrated circuits usable as driver ICs for driving liquid-crystal-display panels, and particularly relates to an LCD data driver that drives data-bus lines of a liquid-crystal-display panel based on display data.

2. Description of the Related Art

A liquid-crystal-display panel has pixels comprised of transistors arranged in a matrix form, with gate-bus lines extending in a horizontal direction connected to the gates of the pixel transistors, and data-bus lines extending in a vertical direction connected to pixel condensers via the transistors. When data is to be displayed on the liquid-crystal-display panel, gate drivers successively drive the gate-bus lines one after another so as to make transistors conductive on a selected horizontal line. Data drivers write data in pixels on the selected horizontal line through the transistors that are made conductive.

In a conventional configuration, generally, the LCD data drivers are commonly connected to a bus for transferring display data signals, clock signals, etc. In such a configuration, signal lines intersect with each other, resulting in a large number of layers provided in an implemented substrate. In order to reduce the number of substrate layers, the LCD data drivers may be connected in cascade connection, thereby supplying the outputs of a given LCD data driver to a next LCD data driver provided at a subsequent stage.

The cascade-connection configuration can reduce the number of substrate layers because the LCD drivers are connected in series without having intersections between the implemented signal lines. This provides a basis for manufacturing the substrates at low costs.

With the LCD data drivers arranged in cascade connection, inputting of a signal into a given driver device results in this signal being supplied to a next driver device via an output buffer. Since a positive transition and a negative transition of a signal have different delays in the buffer due to variation in the manufacturing process, the output signal may end up having a slightly different duty ratio than the input signal.

When LCD data drivers having similar delay characteristics are connected in cascade connection, an error of the duty ratio will be accumulated each time the signal passes through one of the LCD data drivers. After passing through a substantial number of drivers, the error of the duty ratio reaches to such a level that the error cannot be ignored. In an LCD panel of an SXGA type, for example, 10 LCD data drivers are connected in cascade connection, so that accumulated errors of a duty ratio may result in a signal failing to properly propagate.

Accordingly, there is a need for an LCD data driver which is free from accumulation of duty ratio errors, and, also, there is a need for a liquid-crystal-display device using such LCD data drivers.

SUMMARY OF THE INVENTION

It is a general object of the present invention to provide an integrated circuit usable as an LCD data driver and a liquid-crystal-display device using such LCD data drivers that substantially obviate one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by an LCD data driver particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides an integrated circuit, including a first signal-inversion switching circuit which receives a signal supplied from an exterior thereof as a first input signal, followed by outputting the first input signal after logic inversion thereof in response to a first state of a switching signal and outputting the first input signal without logic inversion in response to a second state of the switching signal, a signal processing circuit which performs signal processing based on the output of the first signal-inversion switching circuit, and a second signal-inversion switching circuit which receives the output of the first signal-inversion switching circuit passing through the signal processing circuit as a second input signal, followed by outputting the second input signal after logic inversion thereof in response to the second state of the switching signal and outputting the second input signal without logic inversion in response to the first state of the switching signal.

In an LCD data driver having the circuit configuration of the integrated circuit as described above, the logic of the output signal is inverted relative to the logic of the input signal, thereby canceling errors of the duty ratio caused by timing differences between the delay of positive signal transition and the delay of negative signal transition. Even when the data driver ICs are arranged in cascade connection having a plurality of stages, therefore, the accumulation of duty ratio errors caused by signal propagation can be avoided. Such logic inversion is selectively performed either at the signal stage prior to the internal signal processing or at the signal stage following the internal signal processing in response to the switching signal, thereby insuring that a signal having the regular logic is provided for use by the internal signal processing.

Further, a liquid-crystal-display device according to the present invention includes a liquid-crystal-display panel, a gate driver which drives gate-bus lines of said liquid-crystal-display panel, and a plurality of data drivers which are arranged in cascade connection, and drive data-bus lines of said liquid-crystal-display panel, wherein each of said data drivers receives a signal supplied from a preceding stage and transfers the signal to a following stage after inverting a logic thereof.

Moreover, a signal-transmission system includes a plurality of integrated circuits arranged in cascade connection, wherein each of said integrated circuits receives a signal supplied from a preceding stage and transfers the signal to a following stage after inverting a logic thereof.

In the liquid-crystal-display device and the signal-transmission system as described above, the logic of the output signal is inverted relative to the logic of the input signal, thereby canceling errors of the duty ratio caused by timing differences between the delay of positive signal transition and the delay of negative signal transition. Even when cascade connection is employed to provide a plurality of stages, therefore, the accumulation of duty ratio errors caused by signal propagation can be avoided.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 1:
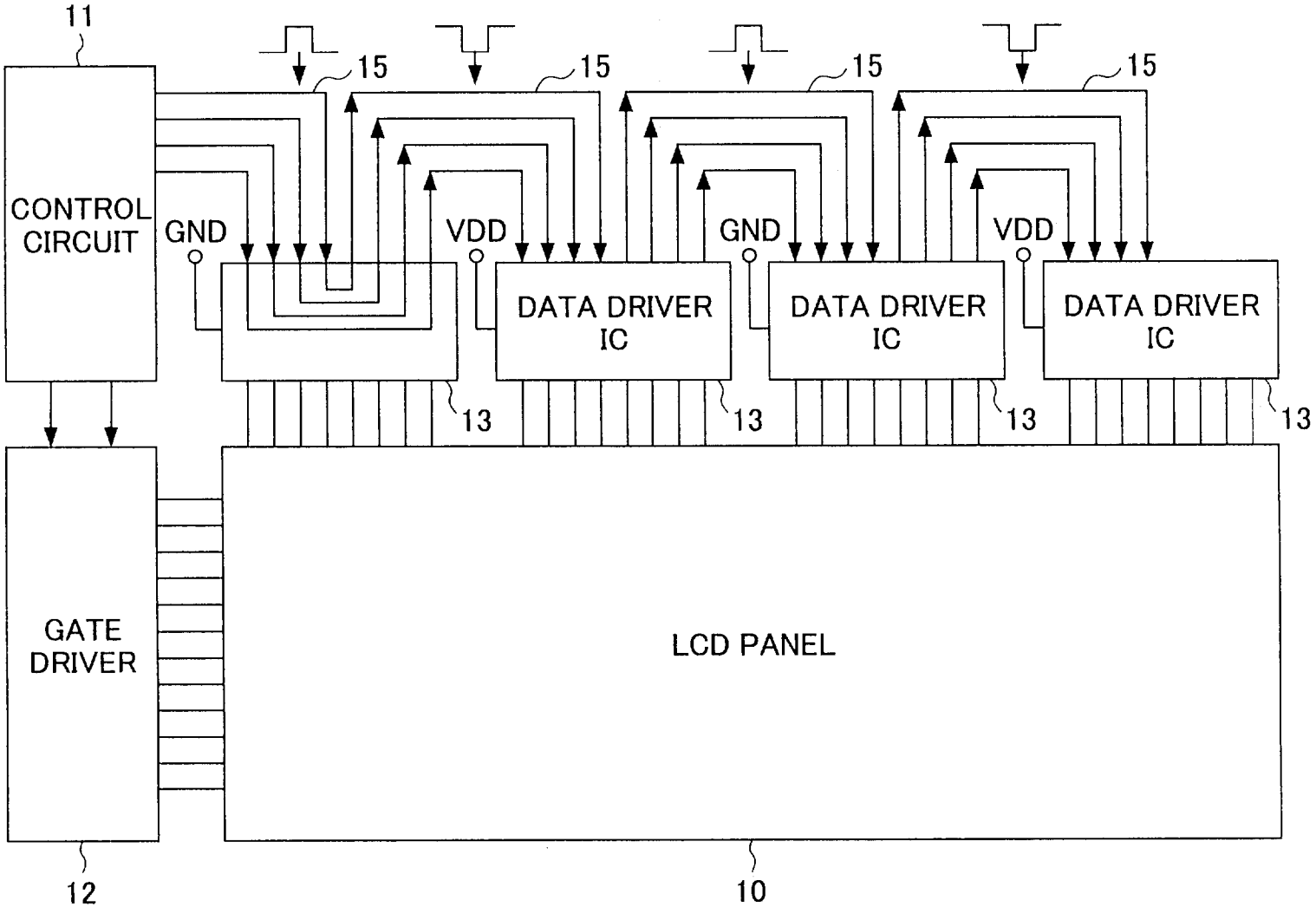
FIG. 1 is a drawing showing an example of a configuration of a liquid-crystal-display device to which the present invention is applied.

FIG. 1 is a drawing showing an example of a configuration of a liquid-crystal-display device to which the present invention is applied.

The liquid-crystal-display device of FIG. 1 includes an LCD panel 10, a control circuit 11, a gate driver 12, and a plurality of data driver ICs 13 connected in cascade connection.

The LCD panel 10 includes pixels comprised of transistors (not shown) arranged in a matrix form, with gate-bus lines extending from the gate driver 12 in a horizontal direction and connected to the gates of the pixel transistors, and data-bus lines extending from the data driver ICs 13 in a vertical direction and connected to pixel condensers via the transistors. When data is to be displayed on the LCD panel 10, the gate driver 12 successively drives the gate-bus lines one after another so as to make transistors conductive on a selected horizontal line. The data driver ICs 13 write data in pixels on the selected horizontal line through the transistors that are made conductive.

The control circuit 11 controls the gate driver 12 and the data driver ICs 13 to display data on the LCD panel 10. The control circuit 11 supplies clock signals, data signals, and various control signals to the data driver ICs 13, and supplies clock signals and various control signals to the gate driver 12.

In the liquid-crystal-display device according to the present invention, the data driver ICs 13 are connected in cascade connection as shown in FIG. 1. Signals that are supplied to the first one of the data driver ICs 13 are then transferred to the next one of the data driver ICs 13 via the first data driver IC 13. Thereafter, the signals are successively supplied from a data driver IC 13 at a given stage to a data driver IC 13 at a next stage.

In the present invention, each data driver IC 13 is configured to invert the logic level of the signals. In FIG. 1, the way the signal logic are inverted is shown on top of the signal lines 15 connecting between the data driver ICs 13. In this manner, each data driver IC 13 inverts the signal logic, thereby canceling errors of the duty ratio caused by differences in delays between the positive transition of the signals and the negative transition of the signals. Accordingly, accumulation of duty ratio errors through signal propagation is avoided even when the data driver ICs 13 are arranged to form a number of stages in cascade connection.

Figure 2:
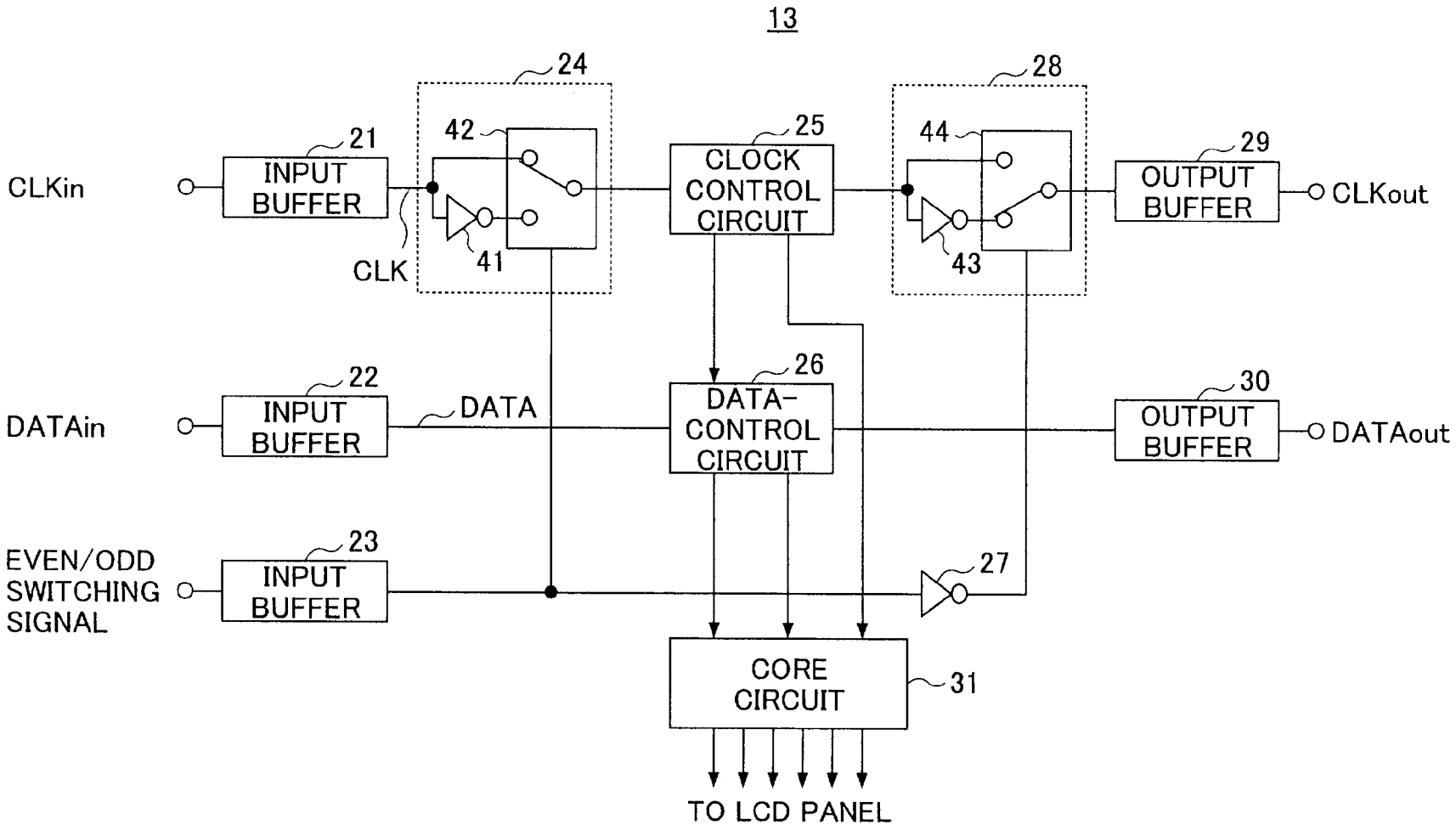
FIG. 2 is a circuit diagram showing an example of the configuration of a data driver IC.

FIG. 2 is a circuit diagram showing an example of the configuration of the data driver IC 13.

The data driver IC 13 of FIG. 2 includes input buffers 21 through 23, a signal-inversion switching circuit 24, a clock control circuit 25, a data-control circuit 26, an inverter 27, a signal-inversion switching circuit 28, output buffers 29 and 30, and a core circuit 31.

The configuration shown in the example of FIG. 2 only inverts the logic of a clock signal CLK. Either one of the signal-inversion switching circuit 24 or the signal-inversion switching circuit 28 inverts the clock signal CLK. Which one of the signal-inversion switching circuit 24 and the signal-inversion switching circuit 28 is used for inversion processing is determined by an even/odd switching signal. Among the data driver ICs 13 connected in cascade connection, odd-number data driver ICs 13 are given a LOW even/odd switching signal, for example, and even-number data driver ICs 13 are given a power-supply potential VDD from the substrate, for example. As shown in FIG. 1, a ground potential GND is supplied from the substrate to the odd-number data driver ICs 13 as the even-odd switching signal, and the power-supply potential VDD is supplied from the substrate to the odd-number data driver ICs 13.

Where an input clock signal CLKin is represented in the logic that is inverse to the regular logic, the signal-inversion switching circuit 24 inverses the logic, thereby providing the clock signal CLK having the regular logic for use in the clock control circuit 25. There is no logic inversion at the signal-inversion switching circuit 28, so that an output clock signal CLKout supplied to the following stage has a logic inverse to the logic of the input clock signal CLKin.

Where the input clock signal CLKin has the regular logic, the signal-inversion switching circuit 24 does not invert the logic, thereby providing the clock signal CLK having the regular logic for use in the clock control circuit 25. In this case, the signal-inversion switching circuit 28 inverts the logic, so that the clock signal CLKout output to the next stage has a logic that is inverse to the logic of the input clock signal CLKin.

In the following, the operation of the data driver ICs 13 will be described in detail.

The input buffer 21 receives the clock signal CLKin from the data driver IC 13 of the preceding stage. If the data driver IC 13 is the first driver in the cascade connection, the clock signal CLKin is supplied from the control circuit 11 of FIG. 1. The input buffer 21 supplies the clock signal CLK to the signal-inversion switching circuit 24. The signal-inversion switching circuit 24 further receives an even/odd switching signal via the input buffer 23.

The signal-inversion switching circuit 24 includes an inverter 41 and a switch 42, and switches the connection of the switch 42 in response to the even/odd switching signal so as to select the clock signal CLK or the inverse of the clock signal CLK that is output from the inverter 41. The selected signal is supplied to the clock control circuit 25. Based on the received clock signal CLK, the clock control circuit 25 generates timing control signals for supply to the data-control circuit 26 and the core circuit 31.

The input buffer 22 receives data signals DATAin from the control circuit 11 or the data driver IC 13 of the preceding stage as shown in FIG. 1, and supplies data signals DATA to the data-control circuit 26. In response to the timing control signals from the clock control circuit 25, the data-control circuit 26 stores in an internal resistor thereof the data signals DATA successively supplied from the input buffer 22. In this manner, the internal resister of the data driver IC 13 stores a fraction of the one-horizontal-period's worth of display data where this fraction corresponds to the display area covered by the data driver IC 13.

The display data stored in the data-control circuit 26 is supplied to the core circuit 31. The core circuit 31 includes a latch circuit, a step-potential generation circuit, an output buffer circuit, etc. The core circuit 31 operates based on the timing control signals supplied from the clock control circuit 25, and latches the display data in the latch circuit as the display data is received from the data-control circuit 26. The display data stored in the latch circuit is supplied to the step-potential generation circuit. The step-potential generation circuit is provided with DA conversion circuits for respective data lines, which convert the received display data from digital to analog, thereby outputting analog gray-scale signals. The output buffer circuit receives the analog gray-scale signals from the step-potential generation circuit through the respective data lines, and outputs the received analog gray-scale signals to the LCD panel 10 as data-line driving signals for driving the data lines.

The clock control circuit 25 receives the clock signal CLK or the inverse thereof from the signal-inversion switching circuit 24, and supplies these signals, as they are, to the signal-inversion switching circuit 28. The signal-inversion switching circuit 28 further receives the inverse of the even/odd switching signal through the input buffer 23 and the inverter 27. The signal-inversion switching circuit 28 includes an inverter 43 and a switch 44, and switches the connection of the switch 44 in response to the inverse of the even/odd switching signal so as to select either the output of the clock control circuit 25 or the inverse of the output of the clock control circuit 25. The selected signal is then supplied to the output buffer 29. The output buffer 29 supplies the received signal to the data driver IC 13 situated at the following stage as the clock signal CLKout.

The data signal DATA passing through the data-control circuit 26 is output as the data signal DATAout from the output buffer 30 to the data driver IC 13 situated at the following stage.

Figure 3A:
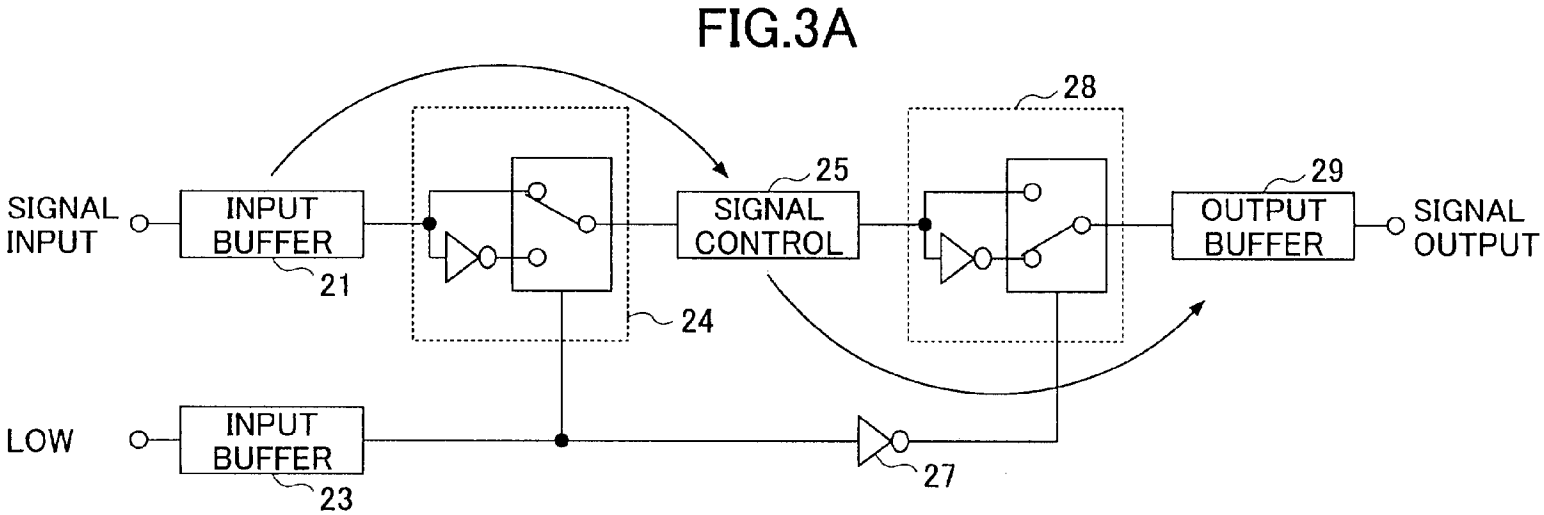
FIGS. 3A and 3B are illustrative drawings for explaining signal-inversion processing that differs between even-number positions and odd-number positions.
Figure 3B:
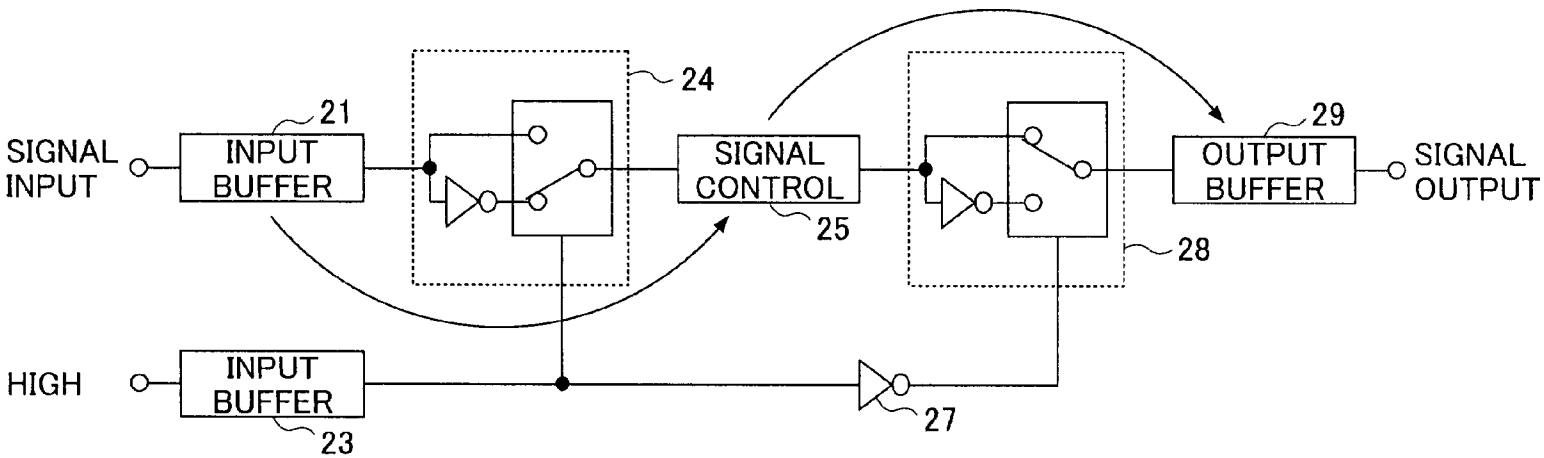

FIGS. 3A and 3B are illustrative drawings for explaining signal-inversion processing that differs between the even-number positions and the odd-number positions.

FIG. 3A shows a signal propagation path provided in the data driver IC 13 positioned at an odd-number stage. FIG. 3B shows a signal propagation path provided in the data driver IC 13 positioned at an even-number stage. In FIG. 3, only signal propagation paths for the clock signal are illustrated, and circuitry relating to data signals is omitted.

In the data driver IC 13 provided at an odd-number stage, the input signal has a regular logic. As shown in FIG. 3A, therefore, the signal-inversion switching circuit 24 does not invert the logic whereas the signal-inversion switching circuit 28 inverts the logic. This makes it possible to control signals in the clock control circuit 25 based on the regular logic signals and to invert the logic between the input signal into the input buffer 21 and the output signal from the output buffer 29.

In the data driver IC 13 provided at an even-number stage, the input signal is an inverse of the regular logic. As shown in FIG. 3B, therefore, the signal-inversion switching circuit 24 inverts the logic whereas the signal-inversion switching circuit 28 does not invert the logic. This makes it possible to control signals in the clock control circuit 25 based on the regular logic signals and to invert the logic between the input signal into the input buffer 21 and the output signal from the output buffer 29.

Figure 4A:
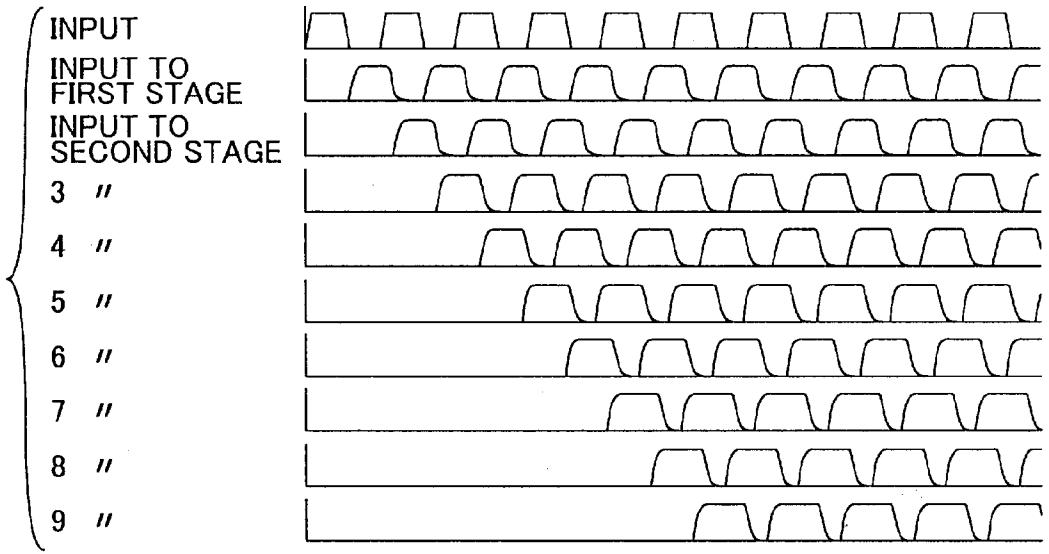
FIGS. 4A and 4B are drawings showing errors of a duty ratio observed when a clock signal propagates through data driver ICs cascaded to form a plurality of stages.
Figure 4B:
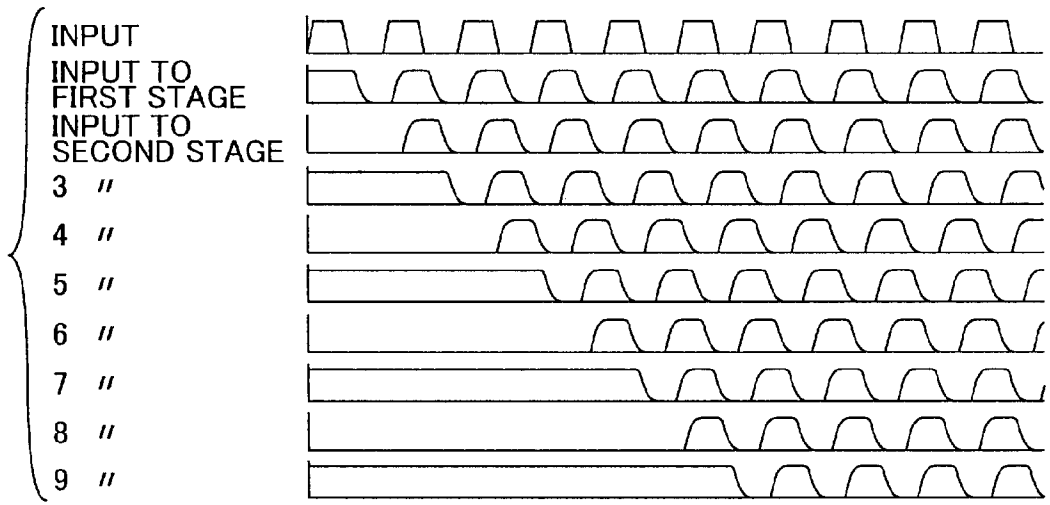

FIGS. 4A and 4B are drawings showing errors of the duty ratio observed when a clock signal propagates through the data driver ICs cascaded to form a plurality of stages.

FIG. 4A shows a clock signal input into the first stage of the plurality of stages of related art data driver ICs, and further shows clock signals output from the respective stages of the data driver ICs. FIG. 4B shows a clock signal input into the first stage of the plurality of stages of data driver ICs according to the present invention, and further shows clock signals output from the respective stages of the data driver ICs. In FIGS. 4A and 4B, output buffers are used that incur a longer delay at the negative transition of the signal than at the positive transition of the signal. In each data driver IC, thus, the output clock signal has a wider pulse width than the input clock signal.

As shown in FIG. 4A, where the related-art data driver ICs are connected in series to form a plurality of stages, errors of the duty ratio will be accumulated at each stage. As a result, the data driver IC at the last stage produces an output having a vastly different waveform than the clock signal input into the first stage that has a 50% duty ratio.

As shown in FIG. 4B, where the data driver ICs 13 of the present invention are connected in series to form a plurality of stages, errors of the duty ratio are cancelled with each other at each stage, resulting in no accumulation of errors. The output of the data driver IC at the last stage thus maintains a waveform similar to the clock signal input into the first stage that has the 50% duty ratio.

In the data driver IC 13 according to the present invention, the logic of the output signal is inverted relative to the logic of the input signal, making it possible to cancel errors of the duty ratio with each other as these errors are created by a difference in delays between the positive signal transition and the negative signal transition. Even when the data driver ICs 13 are connected in cascade connection, therefore, errors of the duty ratio will not be accumulated through signal propagation. The logic-inversion processing may be selectively performed in response to the even/odd switching signal either at the stage preceding the core signal processing or at the stage following the core signal processing. This insures that the signals for use in the core signal processing are presented in the regular logic.

Figure 5:
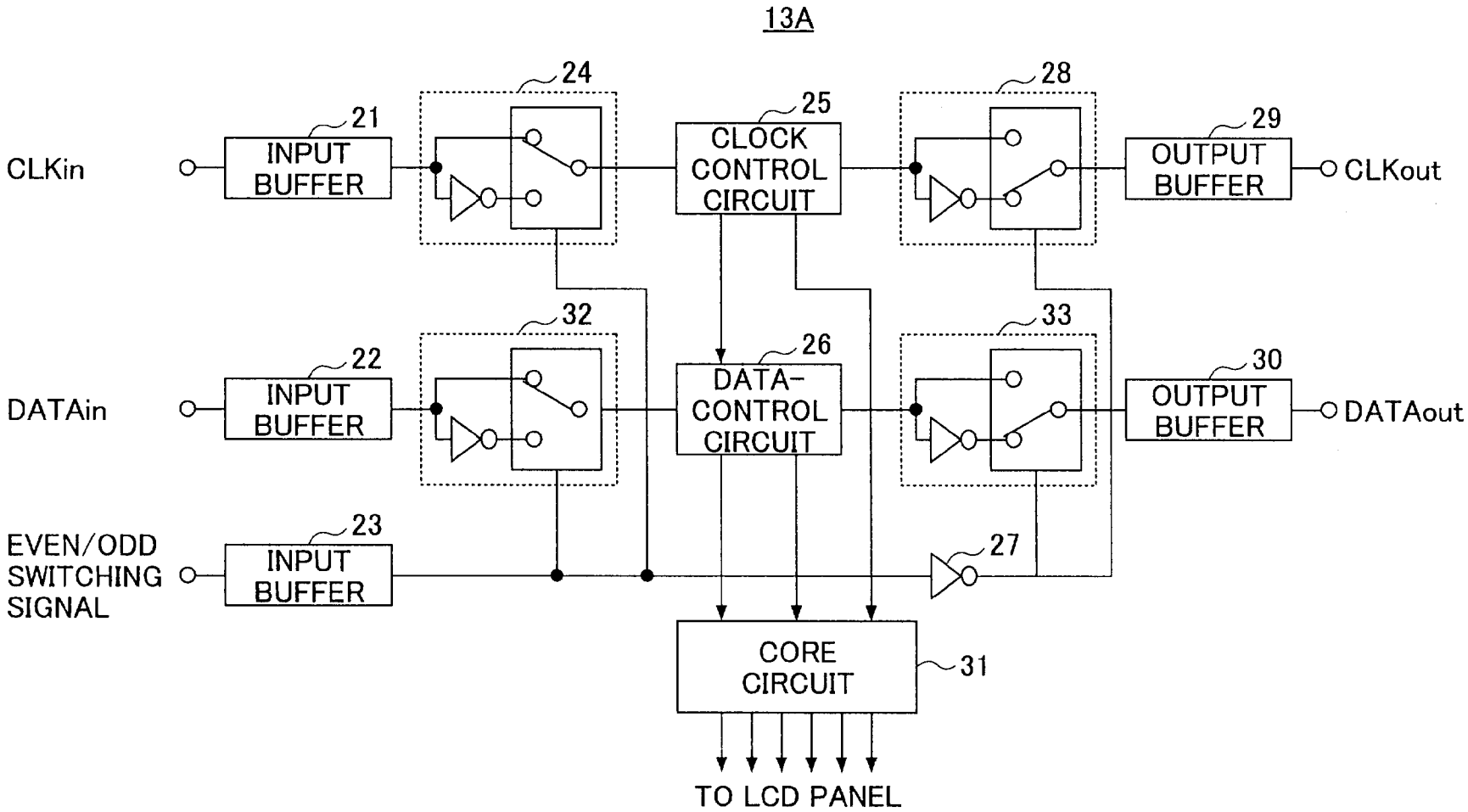
FIG. 5 is a circuit diagram showing an example of another configuration of the data driver IC.

FIG. 5 is a circuit diagram showing an example of another configuration of the data driver IC.

A data driver IC 13A of FIG. 5 differs from the data driver IC 13 of FIG. 2 in that a signal inversion switching circuit 32 and a signal-inversion switching circuit 33 are provided for the purpose of inverting the data signals DATA. Other configurations are the same as those of the data driver IC 13 of FIG. 2.

In an example of FIG. 5, not only the clock signal CLK is logically inverted, but also the data signals DATA are logically inverted. Either one of the signal-inversion switching circuit 32 or the signal-inversion switching circuit 33 inverts the data signals DATA. Which one of the signal-inversion switching circuit 32 and the signal-inversion switching circuit 33 is used for inversion processing is determined by an even/odd switching signal. Among the data driver ICs 13A connected in cascade connection, even-number data driver ICs 13A are given a HIGH even/odd switching signal, for example, and odd-number data driver ICs 13A are given a LOW even/odd switching signal, for example.

Where the data signals DATAin are represented in the logic that is inverse to the regular logic, the signal-inversion switching circuit 32 inverses the logic, thereby providing the data signals DATA having the regular logic for use in the data-control circuit 26. There is no logic inversion at the signal-inversion switching circuit 33 in this case, so that the output data signals DATAout supplied to the following stage has a logic inverse to the logic of the input data signals DATAin.

Where the input data signals DATAin have the regular logic, the signal-inversion switching circuit 32 does not invert the logic, thereby providing the data signals DATA having the regular logic for use in the data-control circuit 26. In this case, the signal-inversion switching circuit 33 inverts the logic, so that the output data signals DATAout output to the next stage has a logic that is inverse to the logic of the input data signals DATAin.

The data driver IC 13A of FIG. 5 operates in the same manner as does the data driver IC 13 of FIG. 2, except for the logic inversion of the data signals DATA, and a description thereof will be omitted.

In the data driver IC 13A of FIG. 5 as described above, the logic of the output signals are inverted relative to the logic of the input signals with respect to both the clock signal CLK and the data signals DATA, thereby canceling errors of the duty ratios caused by timing differences between the delays of positive signal transitions and the delays of negative signal transitions. Even when the data driver ICs 13A are arranged in cascade connection having a plurality of stages, therefore, the accumulation of duty ratio errors caused by signal propagation can be avoided. Such logic inversion is performed either at the signal stage prior to the internal signal processing or at the signal stage following the internal signal processing in response to the even/odd switching signal, thereby insuring that the signals having the regular logic are provided for use by the internal signal processing.

Figure 6:
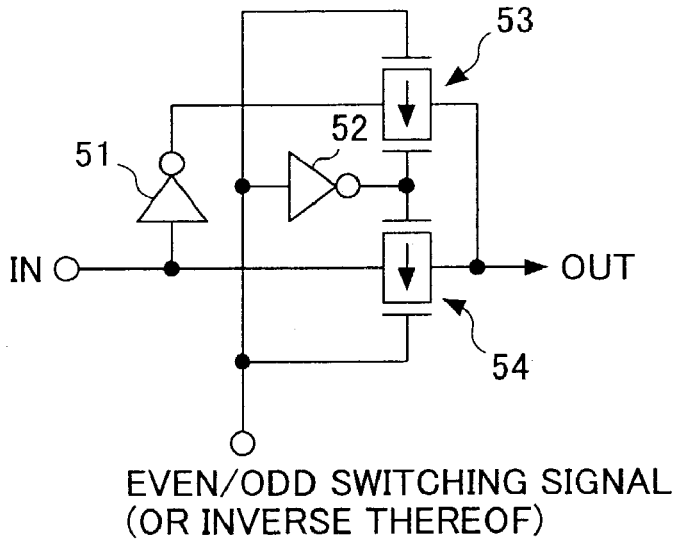
FIG. 6 is a circuit diagram showing an embodiment of a signal-inversion switching circuit according to the present invention.

FIG. 6 is a circuit diagram showing an embodiment of a signal-inversion switching circuit according to the present invention. The signal-inversion switching circuit shown in FIG. 6 may be used as the signal-inversion switching circuits 24 and 28 in FIG. 2, and may be used as the signal-inversion switching circuits 32 and 33 in FIG. 5.

The signal-inversion switching circuit of FIG. 6 includes inverters 51 and 52 and transfer gates 53 and 54. A HIGH level of the even/odd switching signal (or an inverse of the even/odd switching signal) makes the transfer gate 54 conductive, and a LOW level of the even/odd switching signal (or an inverse of the even/odd switching signal) makes the transfer gate 53 conductive. With the conductive state of the transfer gate 54, the input signal IN passes through the transfer gate 54, being output as the output signal OUT. With the conductive state of the transfer gate 53, the input signal IN is inverted by the inverter 51 and passes through the transfer gate 53, being output as the output signal OUT.

Figure 7:
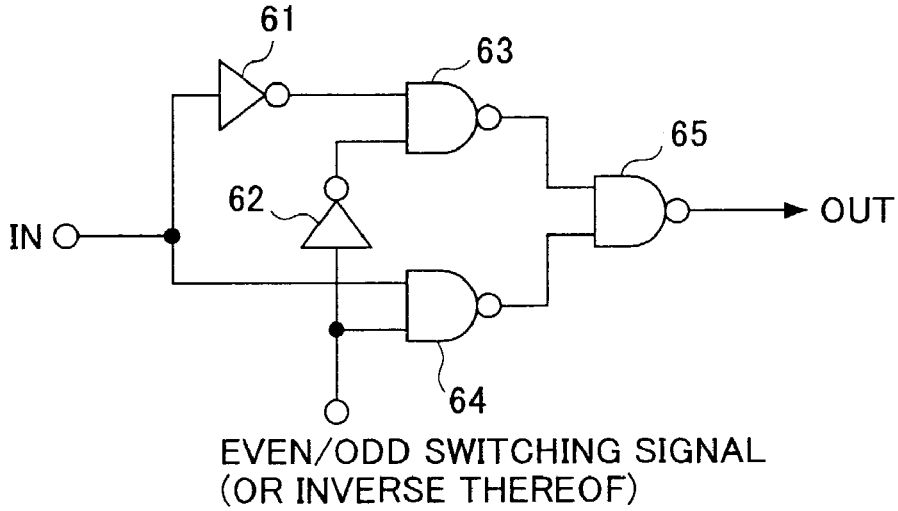
FIG. 7 is a circuit diagram showing another embodiment of the signal-inversion switching circuit according to the present invention.

FIG. 7 is a circuit diagram showing another embodiment of the signal-inversion switching circuit according to the present invention. The signal-inversion switching circuit shown in FIG. 7 may be used as the signal-inversion switching circuits 24 and 28 in FIG. 2, and may be used as the signal-inversion switching circuits 32 and 33 in FIG. 5.

The signal-inversion switching circuit of FIG. 7 includes inverters 61 and 62 and NAND gates 63 through 65. When the even/odd switching signal (or an inverse of the even/odd switching signal) is HIGH, the input signal IN is inverted by the NAND gate 64, and is further inverted by the NAND gate 65. In this case, therefore, the output signal OUT has the same logic as the input signal IN. When the even/odd switching signal (or an inverse of the even/odd switching signal) is LOW, an inverse of the input signal IN output from the inverter 61 is inverted by the NAND gate 63, and is further inverted by the NAND gate 65. In this case, therefore, the output signal OUT has the logic that is inverse to that of the input signal IN.

In this manner, the signal-inversion switching circuit used in the present invention may be easily implemented as a selector circuit based on transfer gates or combination logic circuitry.

Signal logic inversion along the signal propagation paths in the cascade connection according to the present invention may not be limited to data drivers of the liquid-crystal-display device. The signal logic inversion of the present invention may as well be applicable to any system in which a plurality of devices are arranged in cascade connection to allow signals to propagate through the cascades stages. This makes it possible to avoid the accumulation of duty ratio errors at successive stages. The devices used in such systems may be provided with two signal-inversion switching circuits, one at the input end and the other at the output end, thereby achieving proper signal inversion.

Further, the present invention is not limited to these embodiments, but various variations and modifications may be made without departing from the scope of the present invention.

The present application is based on Japanese priority application No. 2002-019518 filed on Jan. 29, 2002, with the Japanese Patent Office, the entire contents of which are hereby incorporated by reference.

What is claimed is:

1. An integrated circuit, comprising:

a first signal-inversion switching circuit having a first input node to receive a first input signal and a first output node to output an output signal, the first signal-inversion switching circuit configured to output an inversion of the first input signal at the first output node in response to a first state of a switching signal and to output the first input signal without logic inversion at the first output node in response to a second state of the switching signal;

a signal processing circuit which performs signal processing based on the output signal of said first signal-inversion switching circuit; and a second signal-inversion switching circuit having a second input node to receive the output signal of said first signal-inversion switching circuit as a second input signal and a second output node to output an output signal, the second signal-inversion switching circuit configured to output an inversion of the second input signal at the second output node in response to the second state of the switching signal and to output the second input signal without logic inversion at the second output node in response to the first state of the switching signal.

2. The integrated circuit as claimed in claim 1, wherein the first input signal is a clock signal, and said signal processing circuit includes:

a clock-control circuit which generates a timing control signal based on the output of said first signal-inversion switching circuit; and a data-control circuit which acquires a data signal supplied from an exterior thereof in response to the timing control signal.

3. The integrated circuit as claimed in claim 2, wherein said signal processing circuit further includes a circuit which generates and outputs a drive signal for driving a liquid-crystal-display panel based on the data signal acquired by said data-control circuit.

4. The integrated circuit as claimed in claim 2, further comprising:

a third signal-inversion switching circuit which receives a signal supplied from an exterior thereof as a first input data signal, followed by outputting the first input data signal after logic inversion thereof to said data-control circuit in response to the first state of the switching signal and outputting the first input data signal without logic inversion to said data-control circuit in response to the second state of the switching signal; and a forth signal-inversion switching circuit which receives the output of said third signal-inversion switching circuit as a second input data signal, followed by outputting the second input data signal after logic inversion thereof in response to the second state of the switching signal and outputting the second input data signal without logic inversion in response to the first state of the switching signal.

5. A liquid-crystal-display device, comprising:

a liquid-crystal-display panel;

a gate driver which drives gate-bus lines of said liquid-crystal-display panel; and a plurality of data drivers which are arranged in cascade connection, and drive data-bus lines of said liquid-crystal-display panel, wherein each of said data drivers receives a signal supplied from a preceding stage and transfers the signal to a following stage after inverting a logic thereof, wherein each of said data drivers includes:

a first signal-inversion switching circuit having a first input node to receive a first input signal and a first output node to output an output signal, the first signal-inversion switching circuit configured to output an inversion of the first input signal at the first output node in response to a first state of a switching signal and to output the first input signal without logic inversion at the first output node in response to a second state of the switching signal;

a signal processing circuit which performs signal processing based on the output signal of said first signal-inversion switching circuit; and a second signal-inversion switching circuit having a second input node to receive the output signal of said first signal-inversion switching circuit as a second input signal and a second output node to output an output signal, the second signal-inversion switching circuit configured to output an inversion of the second input signal at the second output node in response to the second state of the switching signal and to output the second input signal without logic inversion at the second output node in response to the first state of the switching signal.

6. The liquid-crystal-display device as claimed in claim 5, wherein odd-number data drivers of said plurality of data drivers receive the switching signal being in the second state, and even-number data drivers of said plurality of data drivers receive the switching signal being in the first state.

7. A signal-transmission system, comprising:

a plurality of integrated circuits arranged in cascade connection, wherein each of said integrated circuits receives a signal supplied from a preceding stage and transfers the signal to a following stage after inverting a logic thereof, and wherein each of said integrated circuits includes:

a first signal-inversion switching circuit having a first input node to receive a first input signal and a first output node to output an output signal, the first signal-inversion switching circuit configured to output an inversion of the first input signal at the first output node in response to a first state of a switching signal and to output the first input signal without logic inversion at the first output node in response to a second state of the switching signal;

a signal processing circuit which performs signal processing based on the output signal of said first signal-inversion switching circuit; and a second signal-inversion switching circuit having a second input node to receive the output signal of said first signal-inversion switching circuit as a second input signal and a second output node to output an output signal, the second signal-inversion switching circuit configured to output an inversion of the second input signal at the second output node in response to the second state of the switching signal and to output the second input signal without logic inversion at the second output node in response to the first state of the switching signal.

8. The signal-transmission system as claimed in claim 7, wherein odd-number integrated circuits of said plurality of integrated circuits receive the switching signal being in the second state, and even-number integrated circuits of said plurality of integrated circuits receive the switching signal being in the first state.

* * * * *